United States Patent [19]

Tay-Lodge et al.

[11] 4,452,219

[45] Jun. 5, 1984

[54] INDUCTION REGULATOR FOR AN INTERNAL COMBUSTION ENGINE

[76] Inventors: John F. Tay-Lodge, Flats 3/5, 12 Albert Rd., Southport, Merseyside; Bernard L. Proudlock, 44 Briar Rd., Ainsdale, Southport, Merseyside, both of England

[21] Appl. No.: 374,956

[22] Filed: May 5, 1982

[30] Foreign Application Priority Data

| | | | |
|---|---|---|---|
| May 19, 1981 | [GB] | United Kingdom | 8115234 |
| Sep. 16, 1981 | [GB] | United Kingdom | 8127916 |
| Oct. 20, 1981 | [GB] | United Kingdom | 8131539 |

[51] Int. Cl.[3] ..... F02M 33/02

[52] U.S. Cl. ..... 123/591; 123/590; 48/180 R; 48/189

[58] Field of Search ..... 123/591, 592, 593; 48/189.4, 180.1

[56] References Cited

U.S. PATENT DOCUMENTS

| | | | |
|---|---|---|---|
| 3,841,284 | 10/1974 | Krygowski | 123/52 MV |
| 4,187,820 | 2/1980 | Webster et al. | 123/593 |
| 4,359,035 | 11/1982 | Johnson | 123/593 |
| 4,361,128 | 11/1982 | Goldman et al. | 123/593 |

FOREIGN PATENT DOCUMENTS

| | | | |
|---|---|---|---|
| 741462 | 2/1933 | France | 123/591 |
| 574245 | 3/1958 | Italy | 123/593 |
| 359636 | 10/1931 | United Kingdom . | |
| 982461 | 2/1965 | United Kingdom | 123/591 |

*Primary Examiner*—Ronald B. Cox
*Assistant Examiner*—E. Rollins Cross
*Attorney, Agent, or Firm*—Raymond N. Baker

[57] ABSTRACT

An induction regulator for fitting in the inlet manifold of a carbureted internal combustion engine, the regulator serving to balance the fuel flow to match the engine requirements.

The regulator comprises mounting straps (13) forming part of a frame (9). The frame (9) surrounds a wire mesh gauze (11) through which the fuel air mixture passes en route to the engine. An open top reservoir (19) is disposed with its open top adjacent the mesh gauze (11) on the downstream side of the gauze (11) and serves to retain excess unvaporized fuel, and prevent it from passing to the engine. The excess fuel in the reservoir vaporizes when additional fuel is demanded and passes to the engine.

9 Claims, 5 Drawing Figures

INDUCTION REGULATOR FOR AN INTERNAL COMBUSTION ENGINE

DESCRIPTION

The present invention relates to an induction regulator for an internal combustion engine.

To ensure correct operation of an internal combustion engine for example a petrol engine for motor vehicles it is important that the fuel and air are homogeneously mixed and correctly proportioned. This task is assigned to the carburetor and numerous attempts have been made to ensure this. However, under certain circumstances excess unvaporized fuel may be present in the induction manifold, for example cold starting or due to excessive movement of the accelerator pedal by the driver. This excess fuel is invariably wasted and thus leads to excessive fuel consumption and may give rise to the emission of exhaust gases in amounts greater than the permitted levels.

It is an aim of the present invention to compensate for variations in the fuel air mixture fed to an internal combustion engine from the carburetor in order to avoid unvaporized fuel passing into the engine and being wasted.

According to the present invention there is provided an induction regulator for an internal combustion engine, the regulator being adapted to be disposed in the inlet manifold of the engine downstream of the carburetor and comprising a perforated element allowing passage of fuel air mixture therethrough and an open top reservoir for retaining excess unvaporized fuel.

Preferably the perforated element comprises a metal gauze bounded by a frame whose shape corresponds with that of the inlet manifold into which the regulator is to be fitted. Preferably the gauze is planar and disposed at an angle to the manifold wall. The angle may be in the range of 13° to 25° but is preferably 18° when the regulator is positioned at a bend in the manifold for example where the inlet gases change direction between moving vertically and moving horizontally as is the case with a down draught carburetor.

Means are provided for securing the regulator in the manifold and these preferably comprise a pair of metallic strips which depend from the frame bounding the gauze. The free ends of the strips may be bent outwardly at right angles so that they may be clamped between mating flanges of the manifold. For example where the carburetor flange connects to the inlet manifold flange.

The open top reservoir comprises a rectangular tank which is secured to or forms part of the frame and the open top is positioned adjacent the gauze on the downstream side thereof. The tank preferably extends across the width of the gauze in a central position leaving unrestricted passage through the gauze both above and below its longitudinal edges. The arrangement is such that unvaporized fuel collects in the tank and when the engine requires extra fuel it vaporizes from this tank passing initially upstream through the gauze covering the open top of the tank and then downstream through the gauze positioned on either side of the tank. It is believed that the gauze serves to improve atomisation of the fuel air mixture and by virtue of the turbulence created generates a swirling action in the inlet manifold which leads to improved combustion.

The regulator in accordance with the invention has the advantage that it compensates for irregularities in the supply to and demand for fuel from the engine and thus leads to improved fuel consumption, reduced exhaust pollution, and better fuel atomisation vaporization.

The present invention will now be described further, by way of example only, with reference to the accompanying drawings, in which.

Figure 1:
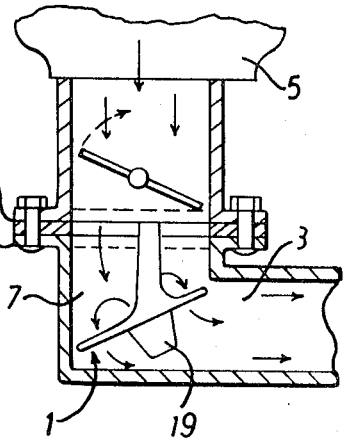
FIG. 1 illustrates the regulator in accordance with the invention located in an induction manifold.
Figure 2:
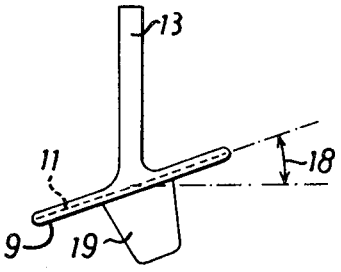
FIG. 2 is an end view of the regulator shown in FIG. 1.
Figure 3:
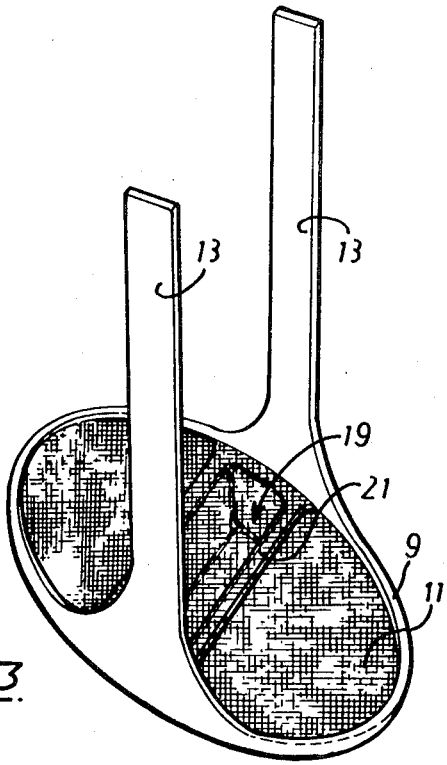
FIG. 3 is a perspective view of the regulator of FIGS. 1 and 2.

Referring now to FIGS. 1 to 3 an induction regulator, generally indicated by the reference numeral 1, is shown disposed in an induction manifold 3 downstream of a carburetor 5. The regulator 1 is positioned at the bottom of the down draught section of the manifold 7 and is angled across the corner where the manifold changes direction from a substantially vertically directed air flow to a substantially horizontally directed air flow. As shown the regulator comprises a frame 9 which bounds a metallic gauze 11 an which acts to support the gauze 11 around its periphery. Two strips of metal 13 depend from the frame and serve as location straps for the regulator 1. The ends of the strips may be bent outwardly at right angles to permit them to be clamped between a flange 15 of the inlet manifold 3 and a flange 17 of the carburetor 5. The frame 9 is disposed at an angle of 72° to the strips 13.

An open top reservoir 19 is secured to the frame and its edges surrounding the open top are formed with a lip 21 which serves to support the gauze 11. The reservoir 19 is elongate and is positioned centrally across the width of the gauze 11, between the points where the strips 13 connect to the frame 9. The gauze 11 extends over the open top of the reservoir 19. The reservoir serves as a drip tank to catch and retain any unvaporized petrol in the induction gases.

Preferably the regulator assembly is made of copper which is a good conductor of heat so that fuel vaporization is aided/accelerated. The size of the gauze is dependent upon the size of the inlet manifold to which the regulator is to be fitted and the mesh size of the gauze is likewise varied to optimise the air flow requirements through the regulator. The capacity of the reservoir may be varied to suit the induction requirements of different capacity engines.

Whilst the embodiment of FIGS. 1 to 3 has been described with respect to a perforated element employing a gauze, the gauze may in certain circumstances be replaced by a metallic plate which has a plurality of through holes. In this way the required number of holes may be formed in the plate to suit the induction requirements.

In the preferred construction the gauze or perforated plate is disposed at an angle of 18° to the axis of the manifold on the downstream side of the regulator. In alternative constructions the angle may vary within the range of 13° to 25°.

Figure 4:
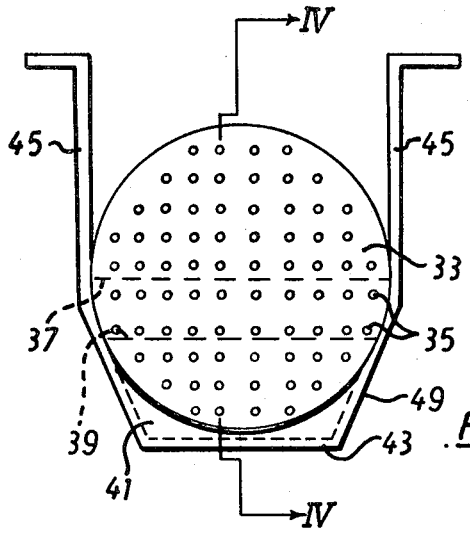
FIG. 4 is a front view of an alternative embodiment of an induction regulator in accordance with the invention.
Figure 5:
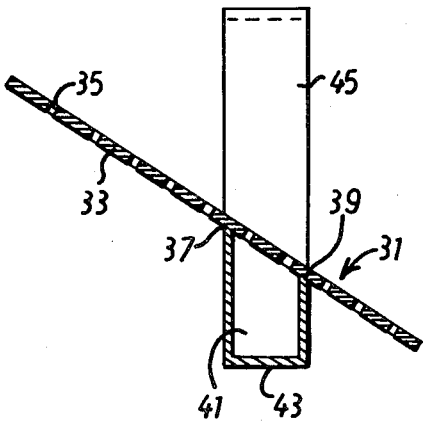
FIG. 5 is a cross-section of the regulator of FIG. 4 taken on the section IV—IV.

Referring now to the FIGS. 4 and 5 an alternative embodiment of the regulator is illustrated. The regulator 31 comprises a perforated metallic plate 33, which has a plurality of holes 35 and which is supported on the edges 37, 39 of a reservoir 41. The plate is to be supported at an angle and this is accomplished by arranging for the edges 37, 39 to be of different heights with respect to the base 43 of the reservoir 41. The reservoir has an open top which is covered by part of the perforated plate 33. Mounting straps 45 depend from the reservoir 41 and in practice form part of the reservoir. The free end of the straps are bent outwardly so that they can be clamped between manifold flanges in the same manner as described with reference to the embodiment of FIGS. 1 to 3. The sides 49 of the reservoir taper inwardly to avoid the outer walls of the manifold. Because a plate is used in place of a gauze no support for the peripheral edges is required, the strength of the plate providing its own support.

Both embodiments of the invention influence the passage of fuel air mixture to the engine in a similar way. Firstly, the perforated plate or gauze acts to improve atomization and hence the mixing of the fuel air as it passes through from the carburetor to the engine. Secondly excess unvaporized fuel present in the inflowing air stream contacts the gauze and collects in the petrol trap reservoir, thus excess fuel is prevented from entering the engine. Thirdly, when the engine operating conditions demand an increased quantity of petrol the fuel contained in the petrol trap reservoir vaporizes, it is believed under the influence of suction in the manifold and passes out of the reservoir through the gauze and down into the engine, thus the device operates to smooth out irregularities in the fuel air mixture.

The induction regulator may be formed integrally with the carburetor or induction manifold and it will be apparent that whilst the regulator has been described with reference to its use at the bend in the inlet manifold this is not essential and the device can be fitted in a position where the air flow is moving in a straight line, be it vertical or horizontal.

We claim:

1. An induction regulator for a carbureted internal combustion engine having an inlet manifold mounting the carburetor to the engine, the regulator being disposed in the inlet manifold downstream of the carburetor and comprising a perforated element which acts to improve atomization of fuel and mixing of fuel and air in allowing passage of fuel/air mixture therethrough on its passage to the engine, an open top reservoir for retaining excess unvaporized fuel, said reservoir being secured to the downstream side of the perforated element and having its open top contiguous to and covered by said perforated element so that retained fuel must be returned through the perforated element for passage to the engine, and attachment means including two elongated mounting straps connected with the perforated element for locating said regulator in the inlet manifold downstream of the carburetor.

2. An induction regulator according to claim 1, wherein a metal gauze serves as the perforated element and a frame surrounds the metal gauze with said mounting straps connected to said frame.

3. An induction regulator according to claim 2 wherein the metal gauze is planar and disposed at an angle to the axis of the inlet manifold.

4. An induction regulator according to claim 3, wherein said reservoir extends across the width of the metal gauze with said reservoir open top having a rectangular configuration defined in part by two longitudinal edges which support the metal gauze within said frame.

5. An induction regulator according to claim 4, wherein said reservoir is positioned centrally with respect to the metal gauze in transverse relationship to the axis of the manifold leaving an unrestricted passage through the metal gauze adjacent the longitudinal edges of said reservoir toward both the upstream and downstream sides of said angled metal gauze.

6. An induction regulator according to claim 4, wherein the mounting straps are secured to said frame at diametrically opposed positions of the metal gauze with the longitudinal sides of the open top reservoir extending between the positions at which the mounting straps connect with said frame.

7. An induction regulator according to claim 3, in which the metal gauze is disposed at an angle within the range of 13° to 25° with respect to the axis of the inlet manifold.

8. An induction regulator according to claim 2, wherein the mounting straps, frame and reservoir are formed from one piece of metal by a pressing and stamping operation.

9. An induction regulator according to claim 1, wherein a rigid metallic plate having a plurality of holes therein serves as the perforated element.

* * * * *